US007922305B2

(12) United States Patent
Iriguchi

(10) Patent No.: US 7,922,305 B2
(45) Date of Patent: Apr. 12, 2011

(54) LIQUID EJECTOR

(75) Inventor: Akira Iriguchi, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 209 days.

(21) Appl. No.: 12/332,506

(22) Filed: Dec. 11, 2008

(65) Prior Publication Data

US 2009/0167822 A1 Jul. 2, 2009

(30) Foreign Application Priority Data

Dec. 28, 2007 (JP) ..... 2007-339972

(51) Int. Cl.
*B41J 2/045* (2006.01)

(52) U.S. Cl. ..... 347/71

(58) Field of Classification Search ..... 347/71, 347/68, 69, 70, 72; 400/124.14, 124.16; 310/311, 324, 327
See application file for complete search history.

(56) References Cited

U.S. PATENT DOCUMENTS 5,218,376 A 6/1993 Asai
5,684,520 A 11/1997 Morikoshi et al.
6,155,673 A 12/2000 Nakajima et al.
6,488,364 B1 12/2002 Nakajima et al.
7,234,789 B2 6/2007 Sekiguchi

FOREIGN PATENT DOCUMENTS

JP 4-10942 1/1992
JP 4220349 8/1992
JP 7-329292 12/1995
JP 2004-154962 6/2004

*Primary Examiner* — K. Feggins
(74) *Attorney, Agent, or Firm* — Frommer Lawrence & Haug LLP

(57) ABSTRACT

A liquid ejector including: a nozzle; a pressure chamber communicating, at one end thereof in a specific direction, with the nozzle; a liquid-store chamber; a restrictor through which the other end of the pressure chamber in the specific direction and the liquid-store chamber communicate with each other; and an actuator having a plurality of piezoelectric layers, a pair of electrode layers, and an active portion that is constituted by a portion of one of the plurality of piezoelectric layers, which portion is interposed between the pair of electrode layers, wherein the active portion is disposed at a position corresponding to the pressure chamber so as to extend in the specific direction, and has a shorter length than the pressure chamber in the specific direction, and wherein a center of the active portion in the specific direction is shifted toward the nozzle than a center of the pressure chamber in the specific direction.

11 Claims, 10 Drawing Sheets

RELATIONSHIP BETWEEN MENISCUS AND PRESSURE

RELATIONSHIP BETWEEN MENISCUS AND PRESSURE

LIQUID EJECTOR

CROSS REFERENCE TO RELATED APPLICATION

The present application claims priority from Japanese Patent Application No. 2007-339972, which was filed on Dec. 28, 2007, the disclosure of which is herein incorporated by reference in its entirety.

BACKGROUND OF THE INVENTION

1. Field of the Invention

The present invention relates to a liquid ejector configured to eject, from nozzles, liquid in the form of liquid droplets.

2. Description of the Related Art

In an ink-jet printer, there are required reducing a size of an ink-jet recording head and reducing sizes of liquid droplets for enhancing a speed of recording and improving a quality of a recorded image, so that sizes of pressure chambers and nozzles of the recording head are reduced. For example, Patent Document 1 (Japanese Patent Application Publication No. 2004-154962) discloses a recording head including (a) a channel unit constituted by a plurality of thin plates which are stacked on each other and in which the pressure chambers, the nozzles, and so on are formed and (b) a piezoelectric actuator stacked on the channel unit. In the piezoelectric actuator, there are provided electrodes which are independent of each other, and each of which overlaps with a central area of a corresponding one of the pressure chambers in plan view. Piezoelectric layers in the actuator are deformed relative to the pressure chambers by applying voltages to the electrodes.

When the liquid droplet is ejected from each of the nozzles, a technique generally called a "fill-before-fire" is employed to obtain a relatively high velocity of ejection by relatively small voltage for driving the recording head. In the "fill-before-fire" technique, the liquid is ejected in the following manner. Pressure fluctuation is generated in the liquid in the pressure chamber by changing a state of the pressure chamber from a volume-reduced state thereof in which a volume of the pressure chamber is reduced, to a volume-increased state thereof in which the volume of the pressure chamber is increased. Then, the state of the pressure chamber is returned to the volume-reduced state thereof at a timing when the pressure is relatively high in the periodic pressure fluctuation, whereby a pressure in the pressure fluctuation and a pressure generated by the reduction of the volume of the pressure chamber are superimposed on each other. As a result, the liquid droplet is ejected from the nozzle. Further, when the liquid droplet is being ejected from the nozzle, the volume of the pressure chamber is increased by applying an additional pulse, whereby a trailing end of the liquid droplet is pulled back. As a result, the size of the liquid droplet is reduced.

SUMMARY OF THE INVENTION

In the liquid ejector, as is well known, the liquid is ejected from each nozzle with a string shape, and is broken into two parts during flying. That is, a leading end portion of the liquid becomes what is called a main liquid droplet (hereinafter, referred to as a "main droplet"), and a trailing end portion of the liquid becomes an undesired liquid droplet called a "satellite droplet".

FIG. 8 is a view showing a positional relationship between a main droplet 101 and a satellite droplet 102 after a lapse of a specific time from the ejection of the liquid where a pulse width is gradually changed. The pulse width means a length of time between (a) increasing, as described above, the volume of the pressure chamber by a front end of a pulse which drives the actuator and (b) returning the state of the pressure chamber to the volume-reduced state thereof by a rear end of the pulse. In a range PH1 of the pulse width (from the third point to the sixth point from the left in FIG. 8), a velocity of ejection of the main droplet 101 is remarkably higher than that in the other widths. That is, the liquid droplet is efficiently ejected. Normally, the range PH1 of the pulse width is used. However, the velocity of the ejection of the satellite droplet 102 is not so high even in the range PH1 of the pulse width, so that the ejected satellite droplet 102 flies behind the ejected main droplet 101 by a distance VH1. Further, since the velocity of the ejection of the satellite droplet 102 is relatively low, the satellite droplet 102 tends to be floated, so that there is a relatively high possibility that the satellite droplet 102 is to be attached to the recording medium at a position distant from the position at which the main droplet 101 is attached. This tends to affect an apparatus, in particular, in which the image is recorded on the recording medium while the recording head and the recording medium are moved relatively to each other.

It is assumed that these phenomena relate to the following things. FIG. 9 is a graph representing a variation with time in a pressure of the liquid near the nozzle and a position of a meniscus of liquid in the nozzle where the recording head is driven at the pulse width at which the liquid is efficiently ejected. The meniscus is a surface of the liquid which contacts with air in the nozzle. The meniscus is retracted by initial increase of the volume of the pressure chamber in the fill-before-fire, and the pressure of the liquid near the nozzle is changed. When the meniscus is retracted at its most retracted position (at a time indicating "Z" in FIG. 9), the pressure of the liquid near the nozzle has already been in a process of increasing. By the increase of the pressure, the leading end of the liquid droplet ejected in the string shape, namely the main droplet 101, is more likely to be ejected early. Further, energy for the trailing end of the liquid droplet, namely the satellite droplet 102, becomes smaller, so that the velocity of the ejection of the satellite droplet 102 lowers. Furthermore, the experiment has showed that a volume of the main droplet 101 is 1.0 pl (pico liter) while a volume of the satellite droplet 102 is 1.2 pl.

As thus described, the main droplet 101 tends to be ejected early. Further, where a viscosity of the liquid is changed by a change of temperature of the liquid, the main droplet 101 is sometimes more likely to be ejected early, thereby causing the position at which the main droplet 101 is attached, to be less stable. Furthermore, since the satellite droplet 102 is ejected in a state in which the satellite droplet 102 is distant from the main droplet 101, the satellite droplet 102 is, as described above, attached to the recording medium at the position distant from the position at which the main droplet 101 is attached. Where the volume of the satellite droplet 102 is relatively large, the quality of the recorded image becomes further worse.

This invention has been developed in view of the above-described situations, and it is an object of the present invention to provide a liquid ejector in which ejection of the main droplet is stabilized while the ejected satellite droplet flies behind the ejected main droplet by a relatively small distance, and which can record a high-qualified image on the recording medium.

The object indicated above may be achieved according to the present invention which provides a liquid ejector comprising: a nozzle from which liquid is ejected; a pressure chamber having an elongate shape extending in a specific direction and communicating, at one of opposite ends thereof in the specific direction, with the nozzle; a liquid-store chamber which stores the liquid that is to be supplied to the pressure chamber; a restrictor through which the other of the opposite ends of the pressure chamber in the specific direction and the liquid-store chamber communicate with each other, and which restricts a flow of the liquid; and an actuator having an active portion for generating pressure fluctuation in the liquid in the pressure chamber; wherein the actuator generates the pressure fluctuation in the liquid in the pressure chamber by changing a state of the pressure chamber from a volume-reduced state thereof to a volume-increased state thereof, and the state of the pressure chamber is returned to the volume-reduced state such that a timing of the returning of the state of the pressure chamber is synchronized with the pressure fluctuation, whereby the liquid in the pressure chamber is ejected from the nozzle, wherein the actuator is disposed on the pressure chamber so as to define the pressure chamber and includes (a) a plurality of piezoelectric layers stacked on each other and (b) a pair of electrode layers between which one of the plurality of piezoelectric layers is interposed, wherein the one of the plurality of piezoelectric layers has a portion which is interposed between the pair of electrode layers and by which the active portion is constituted, wherein the active portion is disposed at a position corresponding to the pressure chamber so as to extend in the specific direction, and formed so as to be shorter than a length of the pressure chamber in the specific direction, and wherein a center of the active portion in the specific direction is positioned nearer to the one end of the pressure chamber which communicates with the nozzle, than a center of the pressure chamber in the specific direction.

In this liquid ejector, the plurality of piezoelectric layers disposed so as to cover a surface of the pressure chamber are deformed, whereby the state of the pressure chamber is changed to the volume-reduced state. In this state, the pressure fluctuation in the liquid in the pressure chamber is generated by increasing the volume of the pressure chamber when the liquid ejector ejects the liquid, and a meniscus of the liquid in the nozzle is pulled toward an inside of the nozzle. Thereafter, a pressure in the pressure fluctuation and a pressure applied to the liquid by returning the state of the pressure chamber to the volume-reduced state by the deformation of the piezoelectric layers are superposed on each other, whereby the meniscus pulled toward the inside of the nozzle is pressed toward an outside of the nozzle to eject liquid.

In the liquid ejectors constructed as described above, a main droplet can be prevented from being ejected early, so that a satellite droplet ejected by the recording head flies behind the ejected main droplet by a relatively small distance.

The object indicated above may be achieved also according to the present invention which provides another liquid ejector comprising: a nozzle from which liquid is ejected; a pressure chamber having an elongate shape extending in a specific direction and communicating, at one of opposite ends thereof in the specific direction, with the nozzle; a liquid-store chamber which stores the liquid that is to be supplied to the pressure chamber; a restrictor through which the other of the opposite ends of the pressure chamber in the specific direction and the liquid-store chamber communicate with each other, and which restricts a flow of the liquid; and an actuator having an active portion for generating pressure fluctuation in the liquid in the pressure chamber; wherein the actuator generates the pressure fluctuation in the liquid in the pressure chamber by changing a state of the pressure chamber from a volume-reduced state thereof to a volume-increased state thereof, and the state of the pressure chamber is returned to the volume-reduced state such that a timing of the returning of the state of the pressure chamber is synchronized with the pressure fluctuation, whereby the liquid in the pressure chamber is ejected from the nozzle, and wherein, when a meniscus of the liquid which is formed in the nozzle is retracted to the most retracted position thereof toward the pressure chamber due to increase in a volume of the pressure chamber, a pressure of the liquid near the nozzle is not in a process of increasing.

In the another liquid ejector, the actuator changes the state of the pressure chamber is changed to the volume-reduced state. In this state, the pressure fluctuation in the liquid in the pressure chamber is generated by increasing the volume of the pressure chamber when the liquid ejector ejects the liquid, and a meniscus of the liquid in the nozzle is pulled toward an inside of the nozzle. Thereafter, a pressure in the pressure fluctuation and a pressure applied to the liquid by returning the state of the pressure chamber to the volume-reduced state by the deformation of the piezoelectric layers are superposed on each other, whereby the meniscus pulled toward the inside of the nozzle is pressed toward an outside of the nozzle to eject liquid. In this time, when the meniscus of the liquid in the nozzle is retracted to its most retracted position by the increasing of the volume of the pressure chamber, a pressure of the liquid near the nozzle is not in a process of increasing. Thus, a main droplet can be prevented from being ejected early, so that a satellite droplet ejected by the recording head flies behind the ejected main droplet by a relatively small distance.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENT

Figure 1:
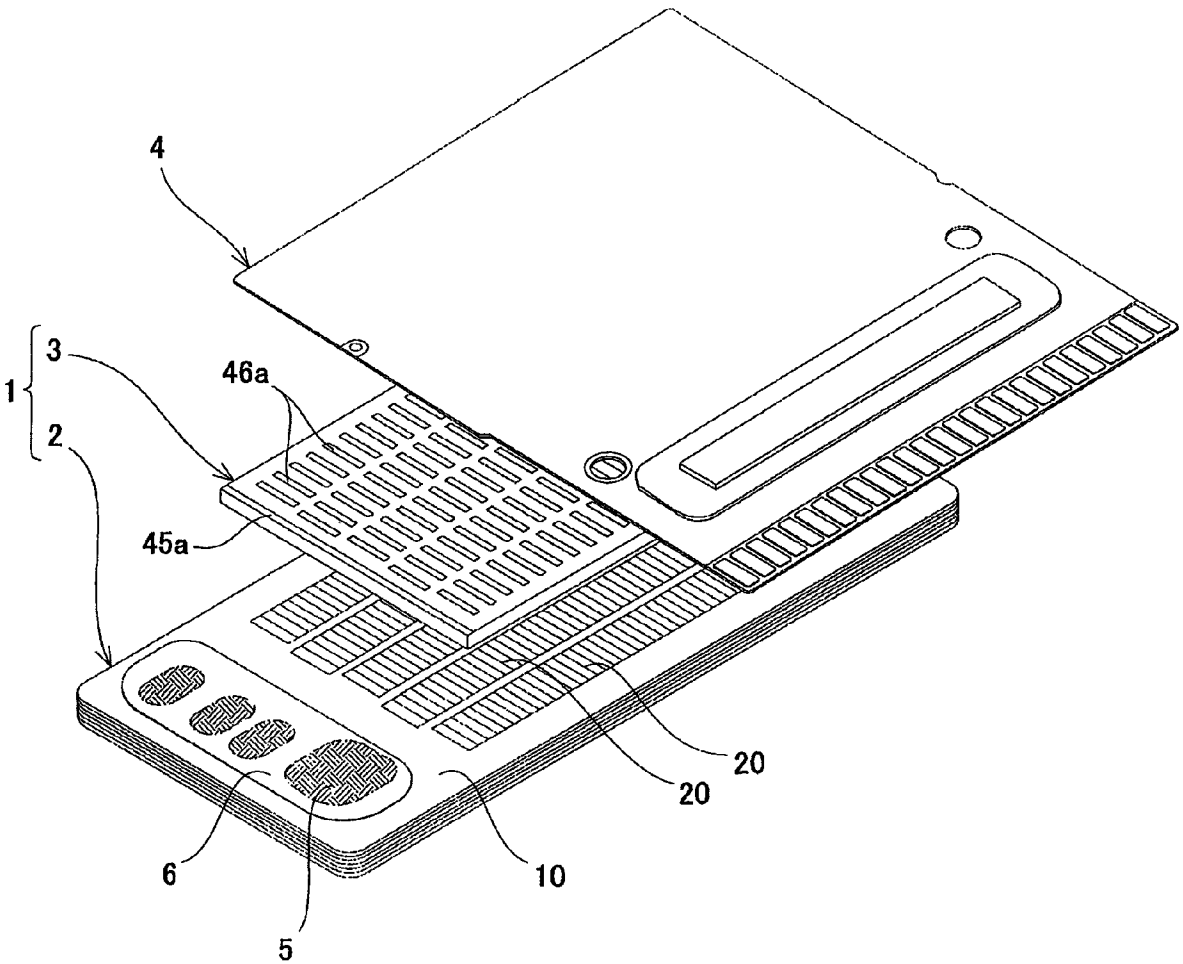
FIG. 1 is a perspective view of an ink-jet recording head as an embodiment of the present invention.

Hereinafter, there will be described a preferred embodiment of the present invention by reference to the drawings. It is to be understood that the following embodiment is described only by way of example, and the invention may be otherwise embodied with various modifications without departing from the scope and spirit of the invention. The present invention is embodied by a liquid ejector. A recording head 1, as the liquid ejector, ejects ink droplets (i.e., liquid droplets) onto a recording medium (not shown) such as a printer sheet while being moved within a plane parallel to the recording medium, thereby forming an image on the recording medium. The recording head 1 includes a channel unit 2 and a piezoelectric actuator (hereinafter, simply referred to as an "actuator") 3 superposed on and bonded to a portion of an upper surface of the channel unit 2.

The channel unit 2 includes nozzles 22 (shown in FIG. 3) opening downward at the lowermost layer of the channel unit 2. The ink droplets are ejected downward from the respective nozzles 22. On an upper surface of the actuator 3, there are provided terminals 45*a*, 46*a* respectively connected to common electrodes 45 and individual electrodes 46 (shown in FIG. 3) which will be described below. The terminals 45*a*, 46*a* are connected to respective terminals (not shown) provided on a lower surface of a flexible flat cable 4, whereby the actuator 3 and a controller (not shown) are electrically connected to each other. Ink inlet holes 5 are formed in another portion of the upper surface of the channel unit 2, which portion is not covered by the actuator 3. The ink inlet holes 5 are covered by a filter 6 for removing dust or foreign matters mixed in ink.

Figure 3:
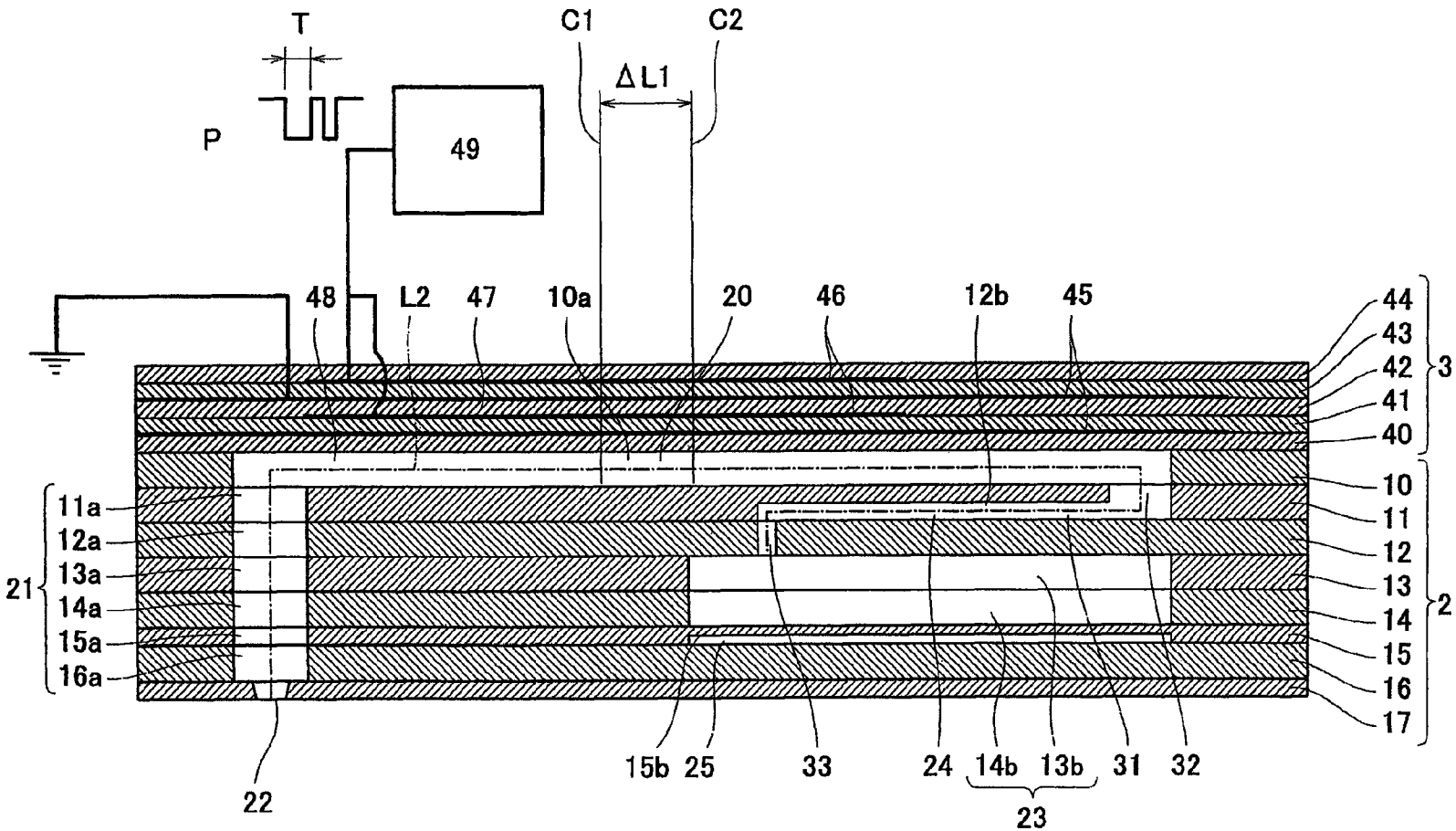
FIG. 3 is a cross-sectional view showing a cross section of the recording head taken along a line III-III in FIG. 2.

As shown in FIG. 3, the channel unit 2 includes, in order from the top, a cavity plate 10, a first supply plate 11, a second supply plate 12, a first manifold plate 13, a second manifold plate 14, a damper plate 15, a cover plate 16, and a nozzle plate 17 which are stacked on and bonded to each other. The nozzle plate 17 is formed of a resin sheet such as polyimide while the other plates 10-16 are each formed of a metal plate such as a 42% nickel alloy steel plate. The plates 10-17 have respective thicknesses each of which falls within a range from about 50 μm to about 150 μm. In each of the plates 10-17, an opening or openings, and/or a recess constituting a channel is or are formed by, e.g., electrolytic etching, laser processing, and plasma jet processing.

Figure 2:
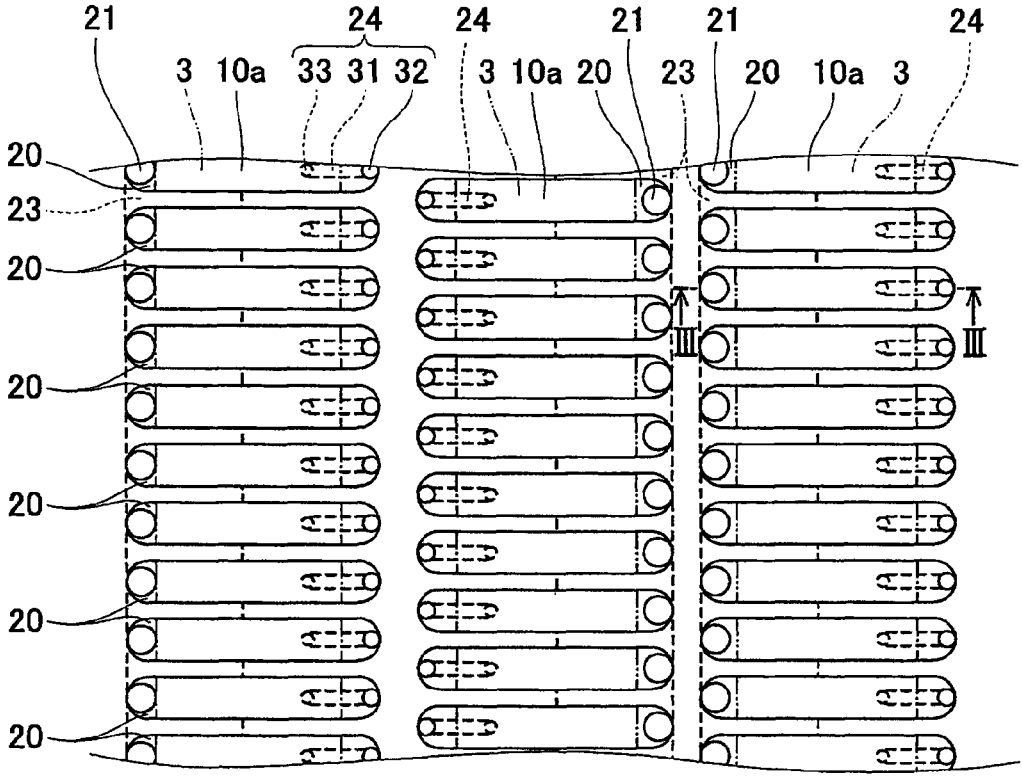
FIG. 2 is a plan view of a channel unit of the recording head.

As shown in FIG. 1, the cavity plate 10 includes a plurality of pressure chamber holes 10*a* arranged in a plurality of rows (five rows in this recording head 1) along longer sides of the channel unit 2. As shown in FIG. 2, each of the pressure chamber holes 10*a* has, in plan view, an oblong shape having a major axis L2 extending in a direction parallel to shorter sides of the channel unit 2. The pressure chamber holes 10*a* are covered with the actuator 3 and the first supply plate 11 respectively from above and below, thereby respectively forming pressure chambers 20. In other words, the actuator 3 is disposed on the pressure chambers 20 so as to define the pressure chambers 20. Thus, each of the pressure chambers 20 has an elongate shape extending in a specific direction which is parallel to the shorter sides of the channel unit 2. Further, the pressure chambers 20 are formed on a virtual plane that is parallel to the specific direction or a longitudinal direction of the pressure chamber 20 and perpendicular to a plates-stacked direction in which the plates 10-17 are stacked on each other.

The lowermost nozzle plate 17 has the nozzles 22, each of which has a shape tapered down to a lower surface of the nozzle plate 17. The nozzles 22 are arranged in rows in correspondence with the arrangement of the pressure chambers 20. More specifically, each of the nozzles 22 communicates with one of opposite ends of a corresponding one of the pressure chambers 20 in its longitudinal direction or the specific direction via a corresponding one of ink-discharge (liquid-discharge) passages 21. Each of the ink-discharge passages 21 is formed by a corresponding one of groups of ink-discharge through holes 11*a*, 12*a*, 13*a*, 14*a*, 15*a*, 16*a* which are respectively formed through the first supply plate 11, the second supply plate 12, the first manifold plate 13, the second manifold plate 14, the damper plate 15, and the cover plate 16, and which communicate with each other.

The first manifold plate 13 includes manifold holes 13*b*, and the second manifold plate 14 includes manifold holes 14*b*. For each of the rows of the pressure chambers 20, a corresponding one of pairs of the manifold holes 13*b*, 14*b* are disposed under each row of the pressure chambers 20. Each pair of the manifold holes 13*b*, 14*b* are arranged in a vertical direction and extends in a direction in which each row of the pressure chambers 20 extends (i.e., a direction parallel to longer sides of the ink-jet head 1). Each pair of the manifold holes 13*b*, 14*b* have approximately the same outline shape. Each manifold hole 13*b* and the corresponding manifold hole 14*b* are arranged in the vertical direction so as to communicate with each other, and are covered respectively by the second supply plate 12 and the damper plate 15 respectively from above and below, thereby forming a corresponding one of common liquid chambers 23. Each of the common liquid chambers 23 functions as a liquid-store chamber which stores the liquid that is supplied to corresponding ones of the pressure chambers 20. The common liquid chambers 23 extend in a direction (a main scanning direction) parallel to the longer sides of the ink-jet head 1, and each projects only from one end of a corresponding one of the rows of the pressure chambers 20 in plan view in the scanning direction. With a portion of each common liquid chamber 23 which thus projects from the one end of the corresponding row of the pressure chambers 20, there are communicating a corresponding one of the ink inlet holes 5 formed through the cavity plate 10 and the first and second supply plates 11, 12 in the vertical direction. It is noted that the following description will be given for one of the pressure chambers 20 for simplicity.

The pressure chamber 20 communicates, via a restrictor 24, with the common liquid chamber 23 located under the pressure chamber 20. The restrictor 24 communicates, at one of opposite ends thereof, with the common liquid chamber 23, and communicates, at the other of the opposite ends thereof, with the pressure chamber 20. The restrictor 24 includes a restrictor passage 31, and a first and second through holes 32, 33. The restrictor passage 31 is formed by a restrictor groove 12*b*. The restrictor groove 12*b* is recessed in a lower surface of the first supply plate 11 adjacent to the second supply plate 12, so as to have a groove shape. The restrictor groove 12*b* has an elongate shape extending along the pressure chamber 20, and is covered and closed by the second supply plate 12. The restrictor passage 31 is disposed between the pressure chamber 20 and the common liquid chamber 23. The first and second through holes 32, 33 are formed through the respective first and second supply plates 11, 12 in the vertical direction (i.e., the plates-stacked direction). The first through hole 32 communicates, at its upper end, with the other of the opposite ends of the pressure chamber 20 in its longitudinal direction, and communicates, at its lower end portion, with one of opposite ends of the restrictor passage 31 in a longitudinal direction thereof which is parallel to the specific direction. The second through hole 33 communicates, at its upper end portion, with the other of the opposite ends of the restrictor passage 31 in the longitudinal direction thereof, and communicates, at its lower end, with the common liquid chamber 23. The restrictor 24 thus formed has a smaller cross-sectional area, in the restrictor passage 31, than the pressure chamber 20 and the common liquid chamber 23. Thus, the restrictor 24 has greater resistance against a flow of the liquid than the pressure chamber 20 and the common liquid chamber 23, thereby restricting the flow of the liquid.

In view of the above, the other of the opposite ends of the pressure chamber 20 in the specific direction and the common liquid chamber 23 communicate with each other through the restrictor 24. More specifically, the common liquid chamber 23 is provided, with a distance from the pressure chamber 20, on a side of the pressure chamber 20 which is opposite to a side thereof on which the actuator 3 is disposed, and the restrictor 24 is provided between the pressure chamber 20 and the common liquid chamber 23 so as to extend in the specific direction.

The damper plate 15 has a damper wall 15*b* whose thickness is reduced by forming a recessed portion in a lower surface of the damper plate 15 which is adjacent to the cover plate 16. The recessed portion formed under the damper wall 15*b* has a larger size than the common liquid chamber 23 in plan view, and forming a damper chamber 25 by being covered and closed by the cover plate 16.

The actuator 3 is of a piezoelectric drive type, and has a structure described below. As shown in FIG. 3, the actuator 3 is disposed on the pressure chamber 20 so as to define the pressure chamber 20. The actuator 3 is configured by stacking a plurality of piezoelectric sheets (layers) 40-44 each formed of a ceramic material of lead zirconate titanate (PZT) having a thickness of about 30 μm. Between the piezoelectric sheets 40, 41 and between the piezoelectric sheets 42, 43, the common electrodes 45 are respectively disposed. Between the piezoelectric sheets 41, 42, and between the piezoelectric sheets 43, 44, the individual electrodes 46 are respectively disposed. That is, among the piezoelectric sheets 40 through 44, the common electrodes 45 and the individual electrodes 46 are alternately inserted. In other words, one of the piezoelectric sheets 40 through 44 is interposed between a pair of a corresponding one of the common electrodes 45 and a corresponding one of the individual electrodes 46. Each of the individual electrodes 46 is formed so as to have a strip shape extending in the longitudinal direction of the pressure chamber 20. Further, each individual electrode 46 has, in plan view, smaller length and width than the pressure chamber 20. Each individual electrode 46 is positioned at a position at which a center of each individual electrode 46 is nearer to the nozzle 22 than a center of the pressure chamber 20 in the specific direction or the longitudinal direction of the pressure chamber 20. In other words, each individual electrode 46 is positioned such that the center of each individual electrode 46 is shifted toward the nozzle 22 from the center of the pressure chamber 20 in the specific direction.

The piezoelectric sheets 41-43 of the actuator 3 have portions each of which is interposed by corresponding ones of the individual electrodes 46 and the common electrodes 45, and each portion constitutes an active portion 47 by a polarization processing in the plates-stacked direction. The active portions 47 have the same shape as the individual electrodes 46 in plan view. It is noted that, in the following explanation, ones of the active portions 47 which are overlapped with each other in the same position in plan view are regarded as one of the active portions 47 for the pressure chamber 20.

Figure 4:
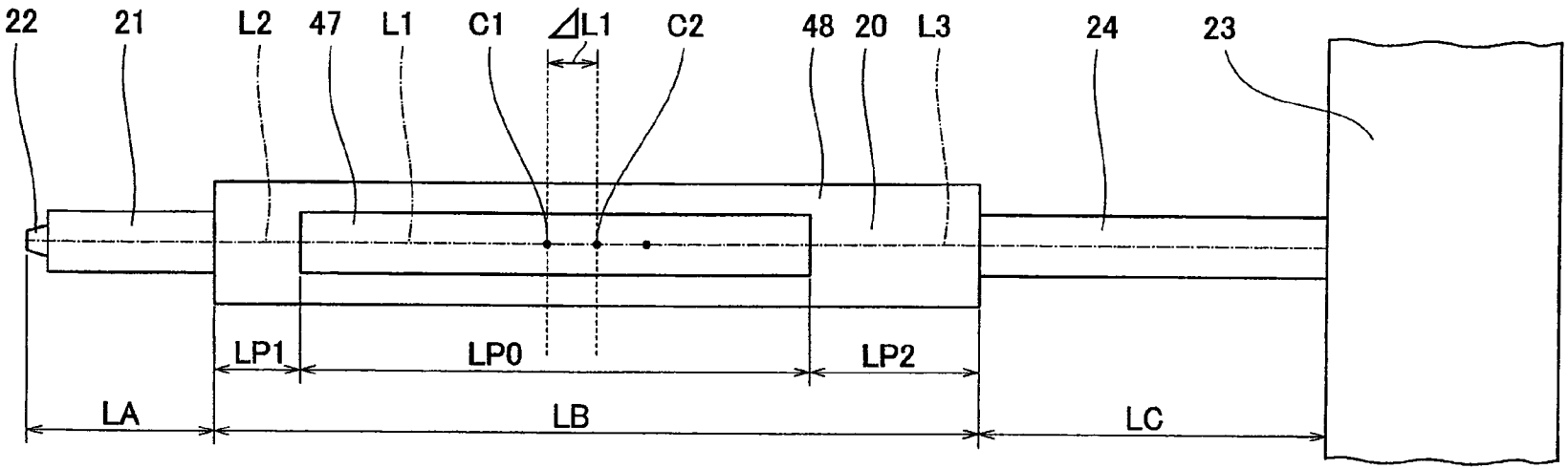
FIG. 4 is a plan view schematically showing a channel extending from a distal end of a nozzle to a common-liquid chamber, with the channel developed into a flat plane.

FIG. 4 is a plan view schematically showing a channel 48 extending from a distal end of the nozzle 22 to the common-liquid chamber 23, with the channel 48 developed into a flat plane and the active portion 47 overlaid. The distal end of the nozzle 22 is an end that is one of opposite ends of the nozzle 22 which is further from the pressure chamber 20. The active portion 47 has the strip shape as described above, and a center line L1 of the active portion 47 in its widthwise direction generally coincides, in plan view seen in the plates-stacked direction, with the major axis L2 of the pressure chamber 20 located under the active portion 47. In the plan view seen in the plates-stacked direction, a center C1 of the active portion 47 in its longitudinal direction or the specific direction is nearer to the nozzle 22 (i.e., to the one end of the pressure chamber 20) than a center C2 of the pressure chamber 20 in its longitudinal direction or the specific direction by a distance ΔL1 (ΔL1>0). That is, the center C1 of the active portion 47 is shifted toward the nozzle 22 from the center C2 of the pressure chamber 20 in the specific direction by the distance ΔL1. In other words, where a distance between the one end of the pressure chamber 20 which is nearer to the nozzle 22 and one of opposite ends of the active portion 47, the one being nearer to the one end of the pressure chamber 20 than the other end of the active portion 47, is defined as an LP1, and where a distance between the other end of the pressure chamber 20 which is nearer to the restrictor 24 and the other of the opposite ends of the active portion 47, the other being nearer to the other end of the pressure chamber 20 than the one end of the active portion 47, is defined as an LP2, the following expression is given: (LP2−LP1)/2=ΔL1.

A ratio of the shifted distance (amount) ΔL1 to a length LB of the pressure chamber 20 in its longitudinal direction, i.e., ΔL1/LB, is set to be between or equal to 0.02 and 0.25. Further, where a distance between the one end of the pressure chamber 20 and the distal end of the nozzle 22 is defined as an LA, and where a distance between the other end of the pressure chamber 20 and the one end of the restrictor 24, the one being nearer to the common liquid chamber 23 than the other end of the restrictor 24, is defined as an LC, a value of ΔL1/(LA+LB+LC) is set to be between or equal to 0.02 and 0.2. The center C1 of the active portion 47 in the specific direction is positioned nearer to the nozzle 22 than a middle portion of the channel 48 in an entire length thereof.

Specifically, the length of the pressure chamber 20 can fall within 500 μm through 1600 μm, the width thereof can fall within 250 μm through 300 μm, and the depth thereof can fall within 40 μm through 60 μm. The length of the channel 48 can fall within 650 μm through 4200 μm. The length of the active portion 47 can fall within 250 μm through 1200 μm. The distance ΔL1 can fall within 50 μm through 150 μm.

More specifically, where the length of the pressure chamber 20 is set to be 500 μm, the length of the active portion 47 is set to be 250 μm, the length of the channel 48 is set to be 650 μm, and the distance ΔL1 is set to be 125 μm, the following expressions can be given: ΔL1/LB=0.25 and ΔL1/(LA+LB+LC)≈0.2.

Further, where the length of the pressure chamber 20 is set to be 1600 μm, the length of the active portion 47 is set to be 1200 μm, the length of the channel 48 is set to be 4100 μm, and the distance ΔL1 is set to be 100 μm, the following expressions can be given: ΔL1/LB≈0.063, and ΔL1/(LA+LB+LC) ≈0.02.

Furthermore, the length of the pressure chamber 20 is set to be 1000 μm, the length of the active portion 47 is set to be 700 μm, the length of the channel 48 is set to be 2200 μm, and the distance ΔL1 is set to be 50 μm through 150 μm, the following expressions can be given: ΔL1/LB≈0.05 through 0.15, and ΔL1/(LA+LB+LC)≈0.02 through 0.07. In the following experiment, the recording head having substantially the same dimensions as these is used.

There will be explained operations of the recording head 1 with reference to FIGS. 2 through 4. The channel 48 extending from the common liquid chamber 23 to the nozzle 22 is filled with the ink introduced from the ink inlet holes 5. The common electrodes 45 of the actuator 3 are grounded while a pulse drive signal P is selectively applied to the individual electrodes 46 of the actuator 3 from a controller 49. In this case, predetermined voltages are applied to the individual electrodes 46 and the common electrodes 45 in a normal state of the recording head. As a result, an electric field is produced between the individual electrodes 46 and the common electrodes 45 in a direction the same as a direction in which the active portion 47 is polarized, whereby the active portion 47 is extended in the plates-stacked direction. Thus, a volume of the pressure chamber 20 is reduced, that is, a state of the pressure chamber 20 becomes a volume-reduced state. The drive signal P is for performing a process in which the applying of the voltages is stopped, and the voltages are applied again. That is, what is called a "fill-before-fire" is performed. It is noted that, in this recording head 1, a length of time from the stopping of the applying of the voltages to the reapplication is referred to as a pulse width T.

By stopping of the applying the voltages, the active portion 47 is contracted again, whereby the volume of the pressure chamber 20 is increased, and simultaneously, the pressure fluctuation is generated in the liquid in the pressure chamber 20. Thereafter, when a pressure in the pressure fluctuation in the liquid becomes relatively high, the active portion 47 is extended by applying of the voltages again. As a result, the relatively high pressure in the pressure fluctuation and the pressure generated by the reduction of the volume of the pressure chamber 20 are superimposed on each other, whereby the liquid is ejected from the nozzle 22. That is, the actuator 3 generates the pressure fluctuation in the liquid in the pressure chamber 20 by changing the state of the pressure chamber 20 from the volume-reduced state thereof to a volume-increased state thereof in which the volume of the pressure chamber 20 is increased, and the state of the pressure chamber 20 is returned to the volume-reduced state such that a timing of the returning of the state of the pressure chamber 20 is synchronized with the pressure fluctuation, whereby the liquid in the pressure chamber 20 is ejected from the nozzle 22. Thereafter, as required, as well as a technique disclosed in the Patent Document 1, the volume of the pressure chamber 20 is increased by applying of an additional pulse, whereby a trailing end of the liquid droplet being ejected is pulled back to reduce a size of the liquid droplet.

Figure 6:
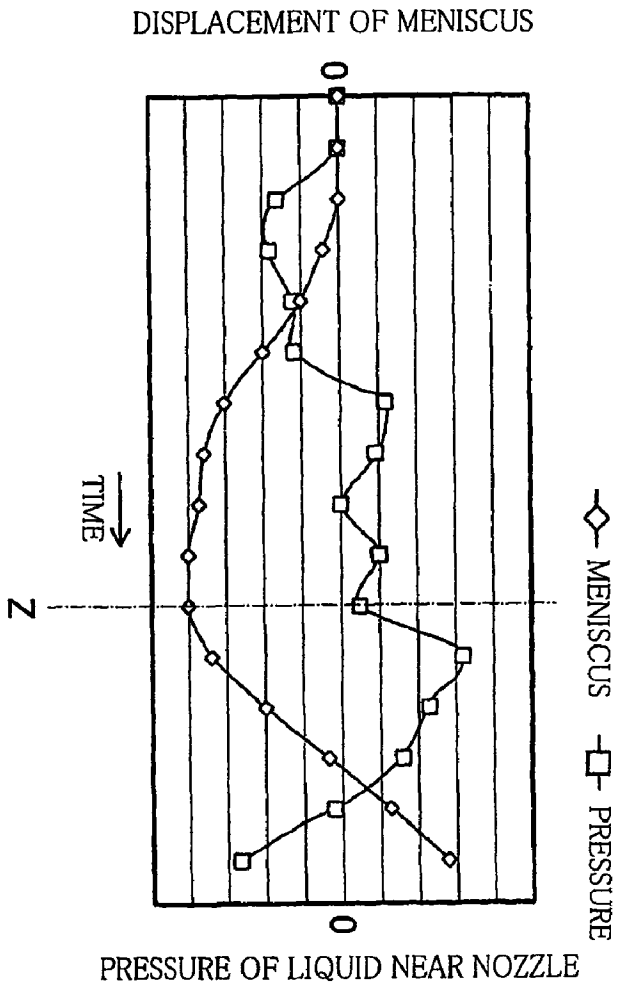
FIG. 6 is a graph representing a variation with time in a pressure of the liquid near the nozzle and a position of a meniscus in the present recording head.
Figure 9:
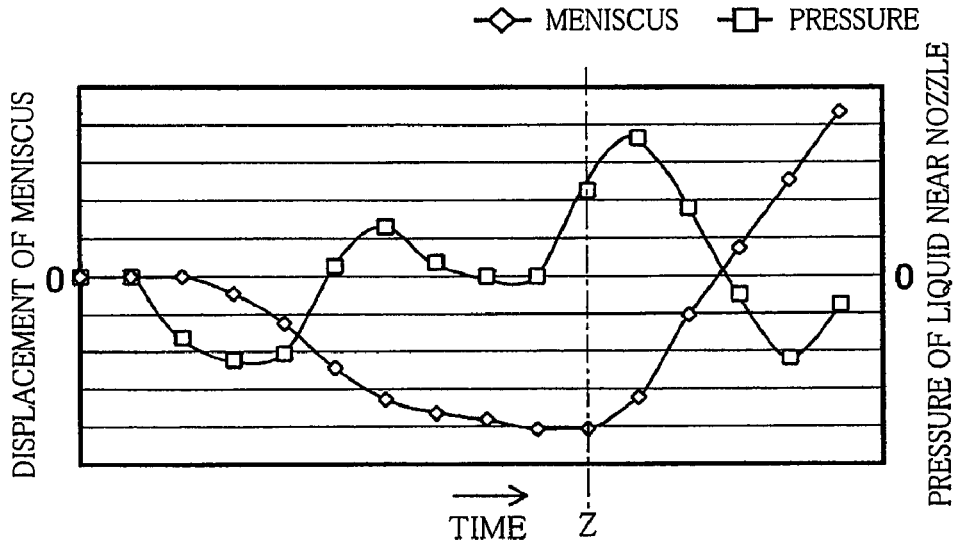
FIG. 9 is a graph representing a variation with time in a pressure of the liquid near the nozzle and a position of a meniscus where the conventional recording head is used.

The actuator 3 changes a shape of an entirety of a portion of the actuator 3, which portion corresponds to an upper surface of the pressure chamber 20, in a direction in which the actuator 3 advances into and retracts from the pressure chamber 20. However, the center C1 of the active portion 47 in its longitudinal direction is, as described above, shifted toward the nozzle 22 from the center C2 of the pressure chamber 20. Thus, a portion of the actuator 3 which is shifted from the center C2 of the pressure chamber 20 (and which corresponds to the active portion 47) is in particular deformed with the greatest amount while the other portions of the actuator 3 are deformed with a smaller amount. That is, a center point at which the active portion 47 presses, by its greatest amount, the liquid in the pressure chamber 20 is shifted toward the center C2 of the pressure chamber 20 unlike the conventional recording head in which the center C1 and the center C2 coincide with each other. Further, a timing of reapplying the pressure to the pressure fluctuation being generated in the liquid in the pressure chamber 20 is also different from that in the conventional recording head. FIG. 6 is a view showing a variation with time in a pressure of the liquid near the nozzle 22 and a position of a meniscus of the liquid in the nozzle 22 when the recording head 1 is driven by a signal having a pulse width with which the liquid is ejected efficiently. The meniscus of the liquid is retracted by an initial increasing of the volume of the pressure chamber 20 in the fill-before-fire, and the pressure of the liquid near the nozzle 22 is also changed. When the meniscus is retracted to its most retracted position (at a time indicating "Z" in FIG. 6), the pressure of the liquid near the nozzle 22 is located, in FIG. 6, at a point generally between a process of decreasing and a process of increasing. In other words, when the meniscus of the liquid which is formed in the nozzle 22 is retracted to the most retracted position thereof toward the pressure chamber 20 due to the increase in the volume of the pressure chamber 20, the pressure of the liquid near the nozzle 22 is not in the process of increasing. More specifically, the center of the active portion 47 in the specific direction is positioned nearer to the one end of the pressure chamber 20 than the center of the pressure chamber 20 in the specific direction such that the pressure of the liquid near the nozzle 22 is not in the process of increasing when the meniscus of the liquid which is formed in the nozzle 22 is retracted to the most retracted position thereof toward the pressure chamber 20 due to the increase in the volume of the pressure chamber 20. Further, the pressure at this point is generally the same as that at an initial time (in an initial state of the recording head 1), and is lower than that in the conventional recording head shown in FIG. 9. Thus, a leading end of the liquid droplet ejected in a string shape, i.e., a main droplet 51, is prevented from being ejected early in comparison with a main droplet 101 in the conventional recording head.

Figure 5:
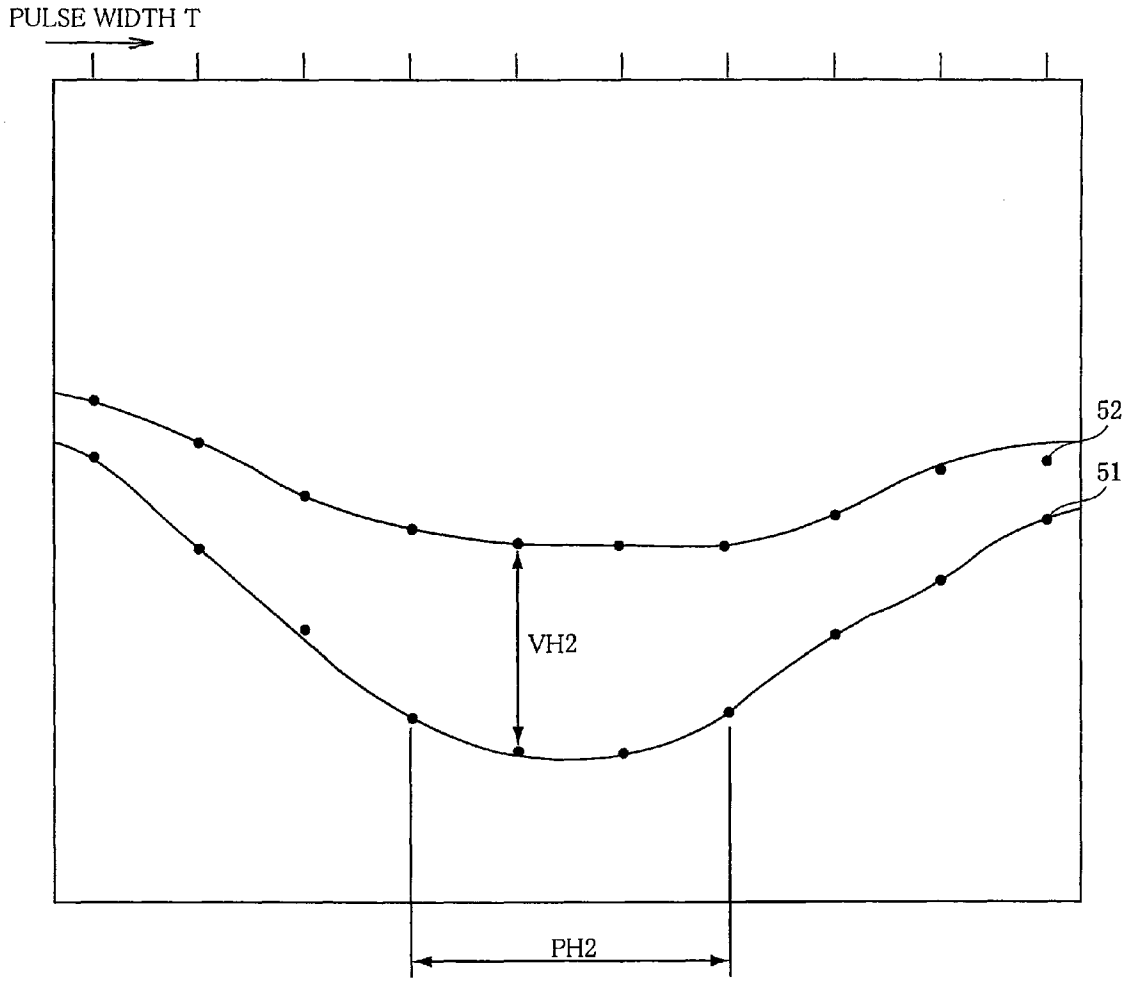
FIG. 5 is a view showing respective positions of a main droplet and a satellite droplet after a lapse of a specific time from ejection of liquid by the present recording head where a pulse width is gradually changed.

FIG. 5 is a view showing a positional relationship of the main droplet 51 and a satellite droplet 52 after a lapse of a specific time from the ejection of the liquid where the pulse width T is gradually changed. In a range PH2 of the pulse width T (from the fourth point to the seventh point from the left in FIG. 5), a velocity of the ejection of the main droplet 51 is remarkably higher than that in the other widths, but the main droplet 51 is less ejected early than the main droplet 101 in the conventional recording head. Thus, a positional difference VH2 between the main droplet 51 and the satellite droplet 52 is smaller than a positional difference VH1, in the conventional recording head, between the main droplet 101 and a satellite droplet 102 whose velocity of the ejection is generally the same as that of the satellite droplet 52. Further, the experiment has showed that a volume of the main droplet 51 is 1.2 pl (pico liter) while a volume of the satellite droplet 52 is 0.7 pl. It can be assumed that the reason why the ejection of the main droplet 51 with a sufficient volume is because the liquid droplet 51 is less ejected early as described above. It is noted that, in the pulse width in the range PH2, the liquid is efficiently ejected at a relatively high velocity, so that the pulse width in the range PH2 is normally used as the drive signal.

As thus described, the main droplet 51 is prevented from being ejected early, and thus a position at which the liquid droplet is to be attached does not become unstable even if a viscosity of the liquid droplet changes owing to a change of a temperature of the liquid. Further, the ejected satellite droplet flies behind the ejected main droplet by a relatively small distance, so that a position at which the satellite 52 is attached becomes nearer to a position at which the main droplet 51 is attached. Further, the volume of the satellite droplet 52 is relatively small. Consequently, the image forming is permitted with high quality.

Figure 7A:
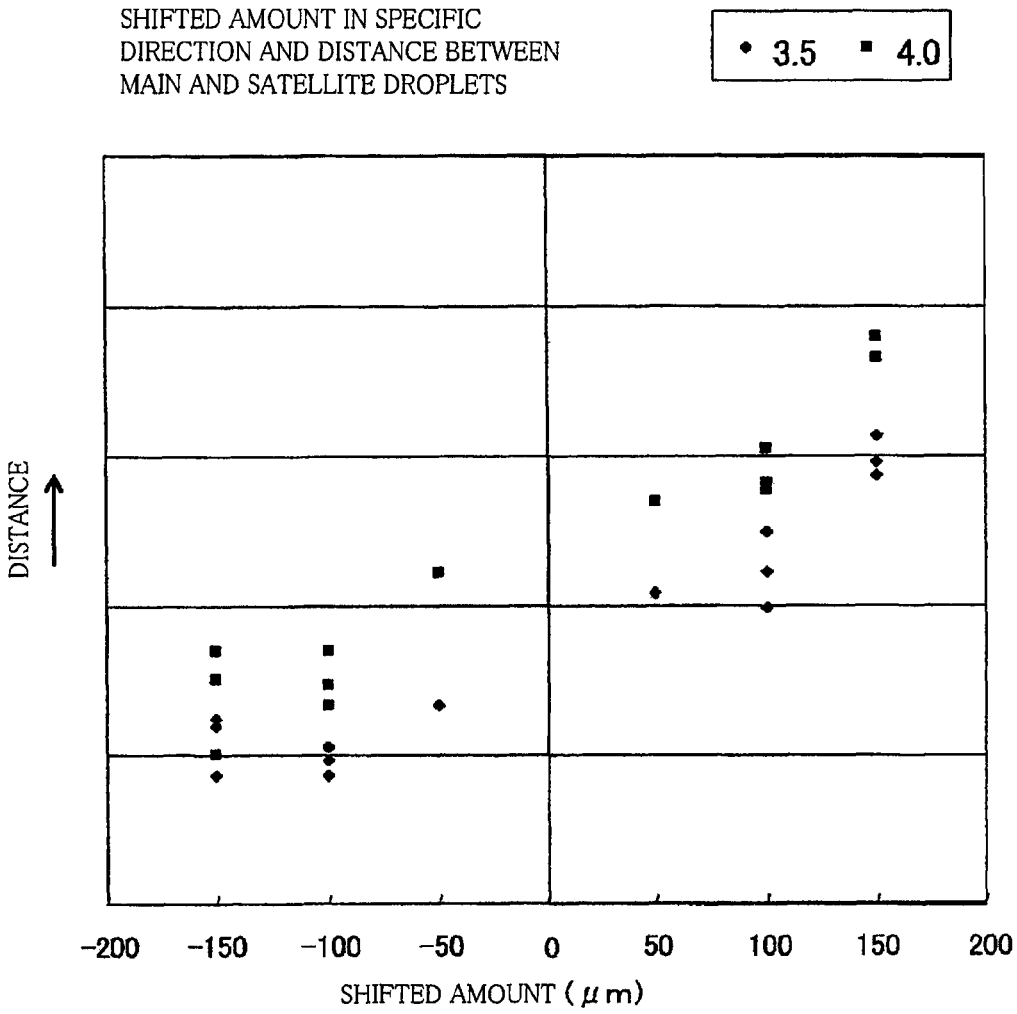
FIG. 7A is a graph representing, in the present recording head, a variation in a distance between positions at which the main droplet and the satellite droplet are attached, with respect to an amount $\Delta L1$ of a shift of a center of an active portion in its longitudinal direction.
Figure 7B:
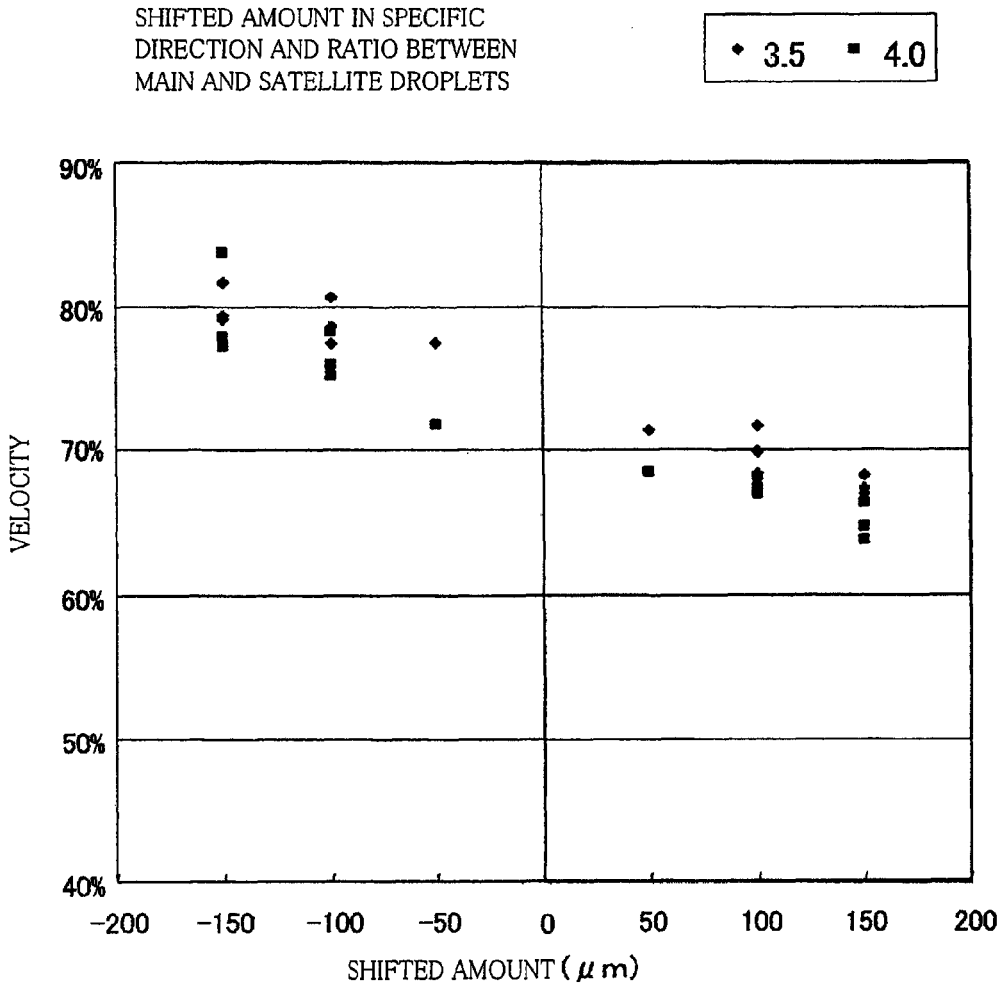
FIG. 7B is a graph representing, in the present recording head, a variation in a ratio between respective velocities of the satellite droplet and the main droplet (the satellite droplet/the main droplet), with respect to the amount $\Delta L1$ of the shift of the center of the active portion in its longitudinal direction.
Figure 8:
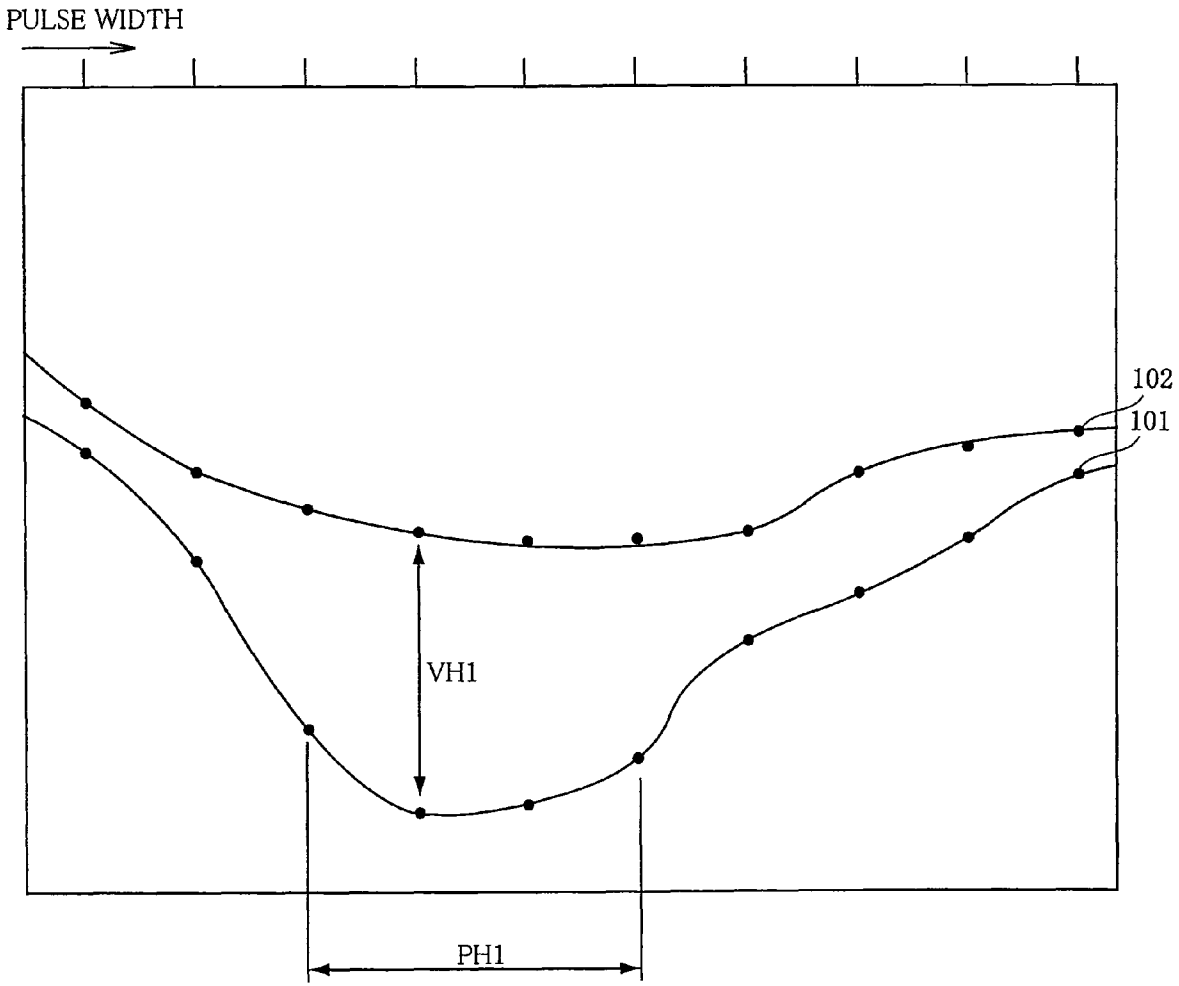
FIG. 8 is a view showing respective positions of a main droplet and a satellite droplet after a lapse of a specific time from ejection of liquid by a conventional recording head where a pulse width is gradually changed.

FIG. 7A is a graph representing a variation in a distance between the positions at which the main droplet 51 and the satellite droplet 52 are attached, with respect to the shifted distance ΔL1 of the center C1 of the active portion 47 in its longitudinal direction, and FIG. 7B is a graph representing a variation in a ratio between respective velocities of the satellite droplet 52 and the main droplet 51 (the satellite droplet 52/the main droplet 51), with respect to the shifted distance ΔL1 of the center C1 of the active portion 47 in its longitudinal direction. Here, there are considered (a) a case where the center C1 of the active portion 47 in its longitudinal direction is shifted toward the nozzle 22 (the shifted distance ΔL1: negative) and (b) a case where the center C1 of the active portion 47 in its longitudinal direction is shifted toward the restrictor 24 (the shifted distance ΔL1: positive). In these cases, the pulse widths T of 3.5 μsec and 4.5 μsec are used each as the drive signal P. The pulse width of 3.5 μsec is represented by rhombus plots while the pulse width of 4.5 μsec is represented by rectangular plots.

As shown in FIG. 7A, where the shifted distance ΔL1 is reduced, that is, the center C1 is shifted toward the nozzle 22, the distance between the positions at which the main droplet 51 and the satellite droplet 52 are attached is reduced, and becomes the smallest value when the shifted distance ΔL1 is −100 μm. That is, the center C1 is shifted toward the nozzle 22, thereby reducing a deviation of the position at which the satellite droplet 52 is attached, from the position at which the main droplet 51 is attached. It is the most preferable that the shifted distance ΔL1 takes a value from −50 μm to −150 μm.

As shown in FIG. 7B, where the shifted distance ΔL1 is reduced, that is, the center C1 is shifted toward the nozzle 22, the ratio of the velocity of the satellite droplet 52 to the velocity of the main droplet 51 is increased. This also shows that the distance between the positions at which the main droplet 51 and the satellite droplet 52 are attached is reduced where the shifted distance ΔL1 is the value from −50 μm to −150 μm.

In view of the above, ΔL1/LB is set to be between or equal to 0.02 and 0.25. Thus, the main droplet can be prevented from being ejected early, so that the ejected satellite droplet flies behind the ejected main droplet by the relatively small distance, that is, the satellite droplet can be ejected with less delay from the ejection of the main droplet. Further, the above-described value of ΔL1/(LA+LB+LC) is set to be between or equal to 0.02 and 0.2. Thus, the main droplet can be prevented from being ejected early, so that the ejected satellite droplet can fly behind the ejected main droplet by the relatively small distance.

In view of the above, when the meniscus of the liquid which is formed in the nozzle 22 is retracted to the most retracted position thereof toward the pressure chamber 20 due to the increase in the volume of the pressure chamber 20, the pressure of the liquid near the nozzle 22 is not in the process of increasing. Thus, the main droplet can be prevented from being ejected early, so that the satellite droplet can be ejected with less delay from the ejection of the main droplet. Further, the center C1 of the active portion 47 is shifted toward the nozzle 22 from the center C2 of the pressure chamber 20 in the specific direction. This facilitates realizing the flying of the ejected satellite droplet behind the ejected main droplet by the relatively small distance. Furthermore, the center C1 of the active portion 47 in the specific direction is positioned nearer to the nozzle 22 than the middle portion of the channel 48 in the entire length thereof. This also facilitates realizing the flying of the ejected satellite droplet behind the ejected main droplet by the relatively small distance.

In view of the above, the cavity plate 10, the supply plates 11, 12, the manifold plates 13, 14, the damper plate 15, the cover plate 16, and the nozzle plate 17 are stacked on each other in this order, so that the pressure chamber 20, the restrictor 24, and the common liquid chamber 23 are arranged in the plates-stacked direction in which the cavity plate 10, the supply plates 11, 12, the manifold plates 13, 14, the damper plate 15, the cover plate 16, and the nozzle plate 17 are stacked on each other. In this state, the one end of the pressure chamber 20 communicates with the nozzle 22 via the ink-discharge passage 21 formed through the supply plate 11 and the cover plate 16, and the other end of the pressure chamber 20 communicates with the common liquid chamber 23 via the restrictor 24. Thus, there can be easily realized a liquid ejector of plates-stacked type which has a satisfactory property of the ejection of the liquid droplets.

This liquid ejector exhibits an excellent effect in which the satisfactory property of the ejection of the liquid droplets can be obtained when the liquid is ejected by the "fill-before-fire". Thus, it is effective that the present invention is applied to, e.g., an apparatus having the recording head or a printing head which ejects the liquid. Further, as well as the apparatus having the recording head, the present invention can be also applied to, e.g., an apparatus for coating a substrate with coloring liquid to manufacture a color filter of a liquid crystal display (LCD), and an apparatus for forming a wiring pattern by ejecting electrically conducting fluid.

What is claimed is:

1. A liquid ejector comprising:

a nozzle from which liquid is ejected;

a pressure chamber having an elongate shape extending in a specific direction coinciding with a longitudinal direction of the pressure chamber, the pressure chamber communicating, at one of opposite ends thereof in the specific direction, with the nozzle;

a liquid-store chamber which stores the liquid that is to be supplied to the pressure chamber;

a restrictor through which the other of the opposite ends of the pressure chamber in the specific direction and the liquid-store chamber communicate with each other, and which restricts a flow of the liquid; and an actuator having an active portion for generating pressure fluctuation in the liquid in the pressure chamber;

wherein the one of the opposite ends of the pressure chamber which communicates with the nozzle is nearer to the nozzle than the other end of the pressure chamber;

wherein the actuator generates the pressure fluctuation in the liquid in the pressure chamber by changing a state of the pressure chamber from a volume-reduced state thereof to a volume-increased state thereof, and the state of the pressure chamber is returned to the volume-reduced state such that a timing of the returning of the state of the pressure chamber is synchronized with the pressure fluctuation, whereby the liquid in the pressure chamber is ejected from the nozzle;

wherein the actuator is disposed on the pressure chamber so as to define the pressure chamber and includes (a) a plurality of piezoelectric layers stacked on each other and (b) a pair of electrode layers between which one of the plurality of piezoelectric layers is interposed;

wherein the one of the plurality of piezoelectric layers has a portion which is interposed between the pair of electrode layers and by which the active portion is constituted;

wherein the active portion is disposed at a position corresponding to the pressure chamber so as to extend in the specific direction, and formed so as to be shorter than a length of the pressure chamber in the specific direction; and wherein a center of the active portion in the specific direction is deviated in the specific direction from a center of a distance in the specific direction between the opposite ends of the pressure chamber, toward the one of the opposite ends of the pressure chamber which is nearer to the nozzle.

2. The liquid ejector according to claim 1, wherein the liquid-store chamber is provided, with a distance from the pressure chamber, on a side of the pressure chamber which is opposite to a side thereof on which the actuator is dispose; and wherein the restrictor is provided between the pressure chamber and the liquid-store chamber so as to extend in a direction parallel to the specific direction.

3. The liquid ejector according to claim 1, wherein where a distance between the one end of the pressure chamber and one of opposite ends of the active portion, the one being nearer to the one end of the pressure chamber than the other of the opposite ends of the active portion, being nearer to the other end of the pressure chamber than the one end of the active portion, is defined as an LP1, where a distance between the other end of the pressure chamber and the other end of the active portion is defined as an LP2, and where the length of the pressure chamber in the specific direction is defined as an LB, a value of (LP2−LP1)/2/LB is set to be between or equal to 0.02 and 0.25.

4. The liquid ejector according to claim 1, wherein where a distance between the one end of the pressure chamber and one of opposite ends of the active portion, the one being nearer to the one end of the pressure chamber than the other of the opposite ends of the active portion, being nearer to the other end of the pressure chamber than the one end of the active portion, is defined as an LP1, where a distance between the other end of the pressure chamber and the other end of the active portion is defined as an LP2, where the length of the pressure chamber in the specific direction is defined as an LB, where a distance between the one end of the pressure chamber and a distal end of the nozzle is defined as an LA, and where a distance between the other end of the pressure chamber and one of end portions of the restrictor, the one being nearer to the liquid-store chamber than the other of the end portions of the restrictor, is defined as an LC, a value of (LP2−LP1)/2/(LA +LB +LC) is set to be between or equal to 0.02 and 0.2.

5. The liquid ejector according to claim 1, further comprising:

a nozzle plate having a nozzle surface in which the nozzle is formed;

a manifold plate for forming the liquid-store chamber;

a supply plate for forming the restrictor; and a cavity plate for forming the pressure chamber;

wherein the nozzle plate, the manifold plate, the supply plate, and the cavity plate are stacked on each other in this order, so that the pressure chamber, the restrictor, and the liquid-store chamber are arranged in a direction in which the nozzle plate, the manifold plate, the supply plate, and the cavity plate are stacked on each other;

wherein the other end of the pressure chamber communicates with the liquid-store chamber via the restrictor; and wherein the one end of the pressure chamber communicates with the nozzle via a liquid-discharge passage formed through the supply plate and the manifold plate.

6. The liquid ejector according to claim 1;

wherein the center of the active portion in the specific direction is positioned nearer in the specific direction to the one of the opposite ends of the pressure chamber, than the center of the distance in the specific direction between the opposite ends of the pressure chamber in the specific direction.

7. A liquid ejector comprising:

a nozzle from which liquid is ejected;

a pressure chamber having an elongate shape extending in a specific direction coinciding with a longitudinal direction of the pressure chamber, the pressure chamber communicating, at one of opposite ends thereof in the specific direction, with the nozzle;

a liquid-store chamber which stores the liquid that is to be supplied to the pressure chamber;

a restrictor through which the other of the opposite ends of the pressure chamber in the specific direction and the liquid-store chamber communicate with each other, and which restricts a flow of the liquid; and an actuator having an active portion for generating pressure fluctuation in the liquid in the pressure chamber;

wherein the actuator generates the pressure fluctuation in the liquid in the pressure chamber by changing a state of the pressure chamber from a volume-reduced state thereof to a volume-increased state thereof, and the state of the pressure chamber is returned to the volume-reduced state such that a timing of the returning of the state of the pressure chamber is synchronized with the pressure fluctuation, whereby the liquid in the pressure chamber is ejected from the nozzle; and wherein, when a meniscus of the liquid which is formed in the nozzle is retracted to the most retracted position thereof toward the pressure chamber due to increase in a volume of the pressure chamber, a pressure of the liquid near the nozzle is not in a process of increasing.

8. The liquid ejector according to claim 7, wherein the one of the opposite ends of the pressure chamber which communicates with the nozzle is nearer to the nozzle than the other end of the pressure chamber; and wherein a center of the active portion in the specific direction is deviated in the specific direction from a center of a distance in the specific direction between the opposite ends of the pressure chamber, toward the one of the opposite ends of the pressure chamber which is nearer to the nozzle, such that the pressure of the liquid near the nozzle is not in the process of increasing when the meniscus of the liquid which is formed in the nozzle is retracted to the most retracted position thereof toward the pressure chamber due to the increase in the volume of the pressure chamber.

9. The liquid ejector according to claim 7, wherein the one of the opposite ends of the pressure chamber which communicates with the nozzle is nearer to the nozzle than the other end of the pressure chamber; and wherein a center of the active portion in the specific direction is deviated in the specific direction from a center of a distance in the specific direction between the opposite ends of the pressure chamber, toward the one of the opposite ends of the pressure chamber which is nearer to the nozzle.

10. The liquid ejector according to claim 7, wherein a center of the active portion in the specific direction is positioned nearer to the nozzle than a middle portion of a channel in an entire length thereof, the channel extending between a distal end of the nozzle and one of end portions of the restrictor, the one being nearer to the liquid-store chamber than the other of the end portions of the restrictor.

11. The liquid ejector according to claim 7, further comprising:

a nozzle plate having a nozzle surface in which the nozzle is formed;

a manifold plate for forming the liquid-store chamber;

a supply plate for forming the restrictor; and a cavity plate for forming the pressure chamber;

wherein the nozzle plate, the manifold plate, the supply plate, and the cavity plate are stacked on each other in this order, so that the pressure chamber, the restrictor, and the liquid-store chamber are arranged in a direction in which the nozzle plate, the manifold plate, the supply plate, and the cavity plate are stacked on each other;

wherein the other end of the pressure chamber communicates with the liquid-store chamber via the restrictor; and wherein the one end of the pressure chamber communicates with the nozzle via a liquid-discharge passage formed through the supply plate and the manifold plate.

* * * * *